US009945063B2

(12) United States Patent
Civanelli et al.

(10) Patent No.: US 9,945,063 B2
(45) Date of Patent: Apr. 17, 2018

(54) WASHING MACHINE WITH HEAT PUMP SYSTEM

(71) Applicant: WHIRLPOOL CORPORATION, Benton Harbor, MI (US)

(72) Inventors: Claudio Civanelli, Travedona (IT); Daniele Martinello, Besozzo (IT)

(73) Assignee: Whirlpool Corporation, Benton Harbor, MI (US)

( * ) Notice: Subject to any disclaimer, the term of this patent is extended or adjusted under 35 U.S.C. 154(b) by 60 days.

(21) Appl. No.: 15/040,999

(22) Filed: Feb. 10, 2016

(65) Prior Publication Data

US 2016/0230329 A1 Aug. 11, 2016

(30) Foreign Application Priority Data

Feb. 11, 2015 (EP) ..... 15154754

(51) Int. Cl.

| | |
|---|---|
| ***D06F 39/04*** | (2006.01) |
| ***D06F 39/00*** | (2006.01) |
| ***F24F 5/00*** | (2006.01) |
| *F24F 3/14* | (2006.01) |

(52) U.S. Cl.

CPC ..... *D06F 39/04* (2013.01); *D06F 39/005* (2013.01); *F24F 5/0096* (2013.01); *F24F 2003/1446* (2013.01)

(58) Field of Classification Search

CPC combination set(s) only.
See application file for complete search history.

(56) References Cited

U.S. PATENT DOCUMENTS 8,973,286 B1 * 3/2015 Hyde ..... D06F 58/206 134/104.1
2016/0160419 A1 * 6/2016 Ryoo ..... D06F 58/206 68/12.14

FOREIGN PATENT DOCUMENTS

| | | | | |
|---|---|---|---|---|
| CN | 102251368 | A | 11/2011 | |
| CN | 102286872 | A | 12/2011 | |
| EP | 2586904 | A1 * | 5/2013 | ..... D06F 58/24 |
| EP | 2749682 | A1 | 7/2014 | |
| JP | 2007289559 | A | 11/2007 | |
| JP | 2010069194 | A | 4/2010 | |

OTHER PUBLICATIONS

European Search Report for Counterpart EP15154754.4, dated Sep. 22, 2015.

* cited by examiner

*Primary Examiner* — Jason Y Ko
*Assistant Examiner* — Cristi Tate-Sims

(57) ABSTRACT

A washing machine comprises a drum and a heat pump system for heating water to be fed to the drum in a washing program. The heat pump system has an evaporator in heat exchange relationship with a room air flow and a condenser in heat exchange relationship with water to be heated, an air deflector being configured to divert said room air flow downstream the evaporator away from the condenser in a water heating configuration and to convey said air towards the condenser in a room air dehumidifying configuration of the washing machine.

13 Claims, 2 Drawing Sheets

WASHING MACHINE WITH HEAT PUMP SYSTEM

CROSS REFERENCE TO RELATED APPLICATIONS

The present application claims the benefit of European Application Serial No. 15154754.4, filed Feb. 11, 2015, the disclosure of which is incorporated herein by reference in its entirety.

BACKGROUND

The present invention relates to a washing machine comprising a drum and a heat pump system for heating water fed to said drum in a washing program of the machine, the heat pump system having an evaporator in heat exchange relationship with air flow and a condenser in heat exchange relationship with said water.

Washing machines using a heat pump system for heating up water are known in the art, for instance form JP 2010069194. These machines have high energy efficiency since during the heating phase a big amount of energy is required to warm up the water, and the use of a heat pump system allows reducing substantially the amount of energy required during this phase. It is possible to implement a heat pump that with a limited amount of energy absorbed from the mains is capable to deliver an amount of heat from 3 to 6 times bigger as heat.

CN102286872 discloses a heat pump laundry dryer which can carry out either a normal drying cycle in which the process air is re-circulated across the evaporator and the condenser of the heat pump system and in the drum, or an ambient room dehumidification cycle where two flaps are placed downstream the exit of air flow from the drum and upstream the entrance of air flow in the drum respectively, so that ambient air is passed though the evaporator and condenser in order to reduce the humidity thereof, and that such dehumidified air is fed back to the ambient. Such solution is quite complex since two diverters or flaps have to be used in the air circuit. Moreover the dehumidification configuration of the dryer can be adopted only when the dryer has finished the drying process. Since a closed-loop heat pump dryer does not emit vapor in the ambient room (humidity is condensed in the evaporator and removed as liquid water), after the drying cycle there is usually no need to reduce the humidity in the ambient air.

On the contrary, washing machines are often installed in small rooms (bathroom or laundry room) and once the washer cycle is ended, the laundry is normally dried using a clotheshorse. As a consequence, the air humidity in the bathroom or laundry room will increase annoying the customer. It is known that at home there is an ideal range of relative humidity, i.e. from 40% to 75%, and that upper end of the range can be easily over passed in rooms where clothes are placed for drying, leading even to possible water condensation on cold surfaces as windows.

SUMMARY OF THE INVENTION

According to the invention, the heat pump system used in the washing machine during the washing program may be used also during such program for a different purpose and after such program ends, by providing a simple air deflector which is configured to direct the room air flow downstream the evaporator towards the condenser in order to dehumidify air as in traditional dehumidifiers. In other words, the solution according to the invention allows combining the heat pump washer with a built-in dehumidifier which can both activated during the same washing program, with obvious advantages either in terms of low cost (one appliance instead of two) and reduced use of space. Since the humidity of ambient air can be decreased during the washing program itself, at the end of the washing program once the clothes are placed in the room to dry, the drying process is quicker than usual.

According to the invention, once the washing cycle is ended and the laundry is drying on the clotheshorse, the customer can select a dedicated cycle on the user interface of the washing machine to use the heat pump of the washer as a dehumidifier in order also to further increase the speed of the drying process.

By reducing the humidity in the air, the clothes will dry faster providing another benefit to the customer.

According to the invention, a washing machine comprises a drum (D), and a heat pump system (HP) for heating water to be fed to the drum (D) in a washing program. The heat pump system (HP) comprises an evaporator (18) in heat exchange relationship with a room air flow (A), and a condenser (14) in heat exchange relationship with said water. An air channel (26) with a deflector (24) is configured to alternatively divert said room air flow (A) downstream of the evaporator (18) away from the condenser (14) during water heating and to convey said air flow (A) towards the condenser (14) in a room air dehumidifying configuration of the washing machine.

According to the invention, a method for controlling a washing machine comprising a drum (D) and a heat pump system (HP) for heating water to be fed to the drum (D) in a washing program, the heat pump system (HP) having an evaporator (18) in heat exchange relationship with a room air flow (A) and a condenser (14) in heat exchange relationship with said water, of the method comprising conveying said room air flow (A) downstream the evaporator (18) towards the condenser (14) in order to obtain a dehumidification of the air flow (A) without a temperature decrease thereof.

DESCRIPTION OF EMBODIMENTS OF THE INVENTION

With the term "heat pump system" we mean any kind of device, either mechanical or thermoelectric, which is capable of creating two zones at different temperatures. For thermoelectric devices which exploit Peltier effect, a cool surface corresponds to the evaporator of a heat pump using a refrigerating fluid, and a warm surface corresponds to the condenser of the heat pump.

Further features and advantages according to the present invention will become clear from the following detailed description, with reference to the attached drawings in which.

Figure 1:
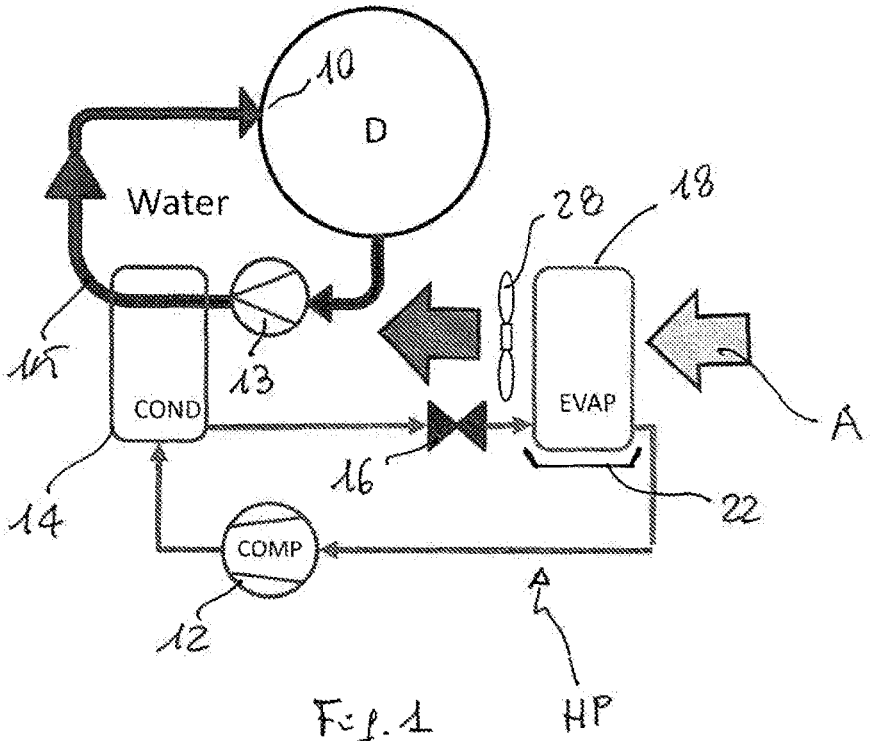
FIG. 1 is a schematic view of a heat pump washing machine according to the invention.

With reference to the drawings, a heat pump washing machine according to the invention comprises a drum D in which water is fed in 10, and a heat pump HP which comprises a compressor 12, a condenser 14, an expansion valve or capillary 16 and an evaporator 18. The washing machine comprises a water recirculation pump 13 and a recirculation conduit 15. Other components of the washing machine, for instance connections with the water main, detergent distributor, motor, suspensions, drain system and the like are not hereby described because they are well known in the art and do not interact directly with the heat pump HP. The energy to warm up the washing liquor is delivered through the condensation of the refrigerant in the coaxial condenser 14, as the one illustrated in FIG. 4. Of course a traditional heater (not shown) can be also provided in order to have a wider range of water temperatures.

The phase change from gas to liquid of the refrigerant fluid flowing in the heat pump HP makes available to the water (that flows in an inner pipe 20) the condensation heat. The advantage of such a system is that the heat pump HP is capable to deliver at the condenser an energy amount that is several times the energy absorbed from the mains (typically 3 to 6 times, according to the different working points).

The evaporator 18 absorbs energy from the ambient air delivering it to the refrigerant fluid. This means that the air temperature will be reduced in passing through the evaporator 18.

If the relative humidity of the air is close to 100% (very common if the wet laundry is drying in a small room) the humidity in the air will start to condense passing through the evaporator plates, reducing the humidity content, and collecting in a removable tank 22 (similar to the removable container of clothes drying machines).

Figure 2:
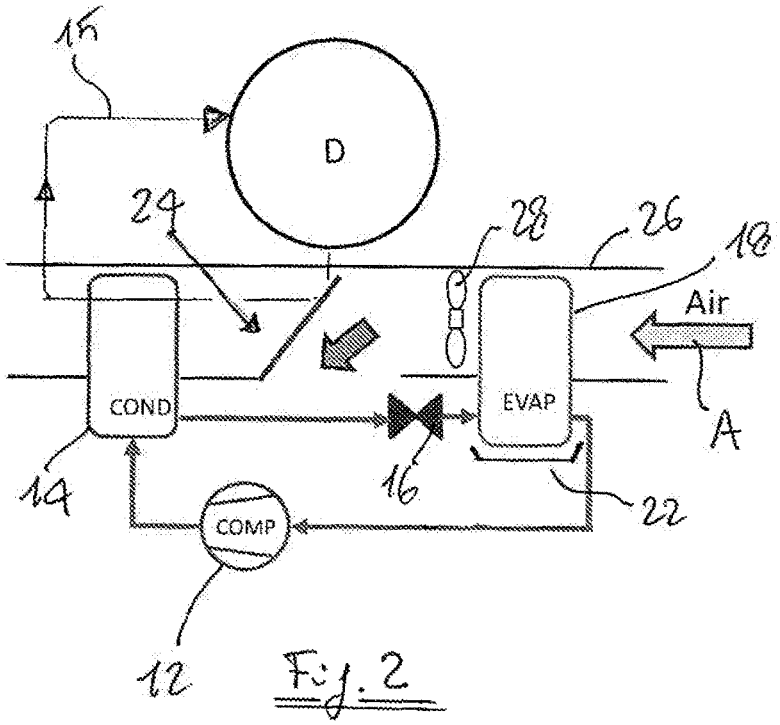
FIG. 2 is a detail of FIG. 1 and shows the washing machine in a washing configuration.
Figure 3:
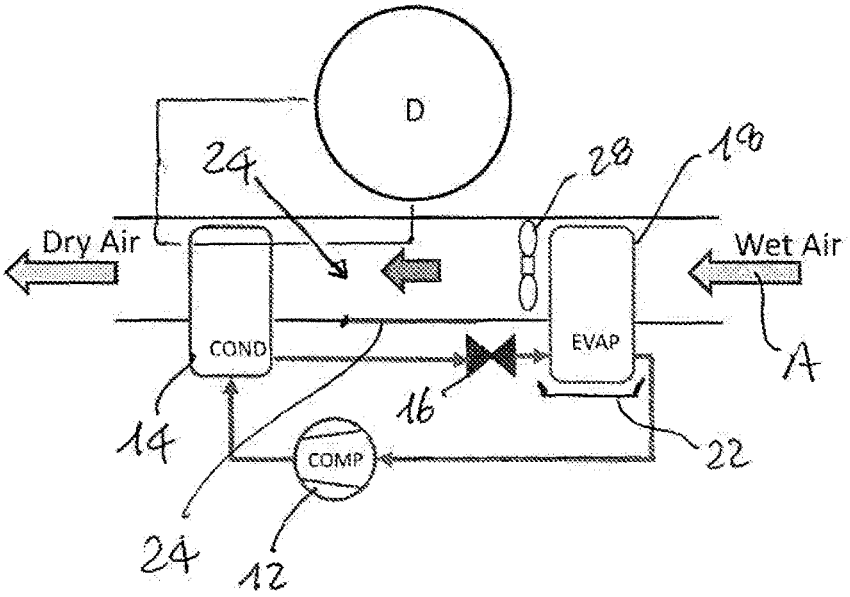
FIG. 3 is similar to FIG. 2 and shows the washing machine in an air dehumidifying configuration.

According to the invention, the washing machine is designed for a specific cycle that will run the heat pump HP when the washing program is still running or already ended and according to which a deflector 24 (FIGS. 2 and 3) will be moved from a first configuration shown in FIG. 2 (where air flow is not impinging the condenser 14) to a second configuration shown in FIG. 3 where the deflector 24 is in a "closed position" allowing the air flow downstream the evaporator 18 to cool down the condenser 14. In this configuration (FIG. 3) the heat pump HP and related air channel 26 with fan 28 acts as an air dehumidifier, i.e. it will feed dehumidified air flow in the room at about the same temperature before entering the conduit 26.

The deflector 24 is configured to assume a configuration in which it deflects the air flow towards ambient from the air channel 26 (open position—FIG. 2) and a configuration in which it is substantially part of the air channel 26 (closed position—FIG. 3).

In the "closed position" of the diverter 24 of FIG. 3, the ambient air will pass through the evaporator plates reducing its humidity and temperature, and then it will be warmed up by the condenser 14.

During the washing phase the condenser 14 may be used to warm up the water, during the dehumidifier phase (which may be carried out also during the washing phase) the condenser 14 will be cooled down by air.

This requires preferably a different heat exchanger (condenser), or at least a modification of the existing one, in order to be able to deliver heat to air.

Figure 4:
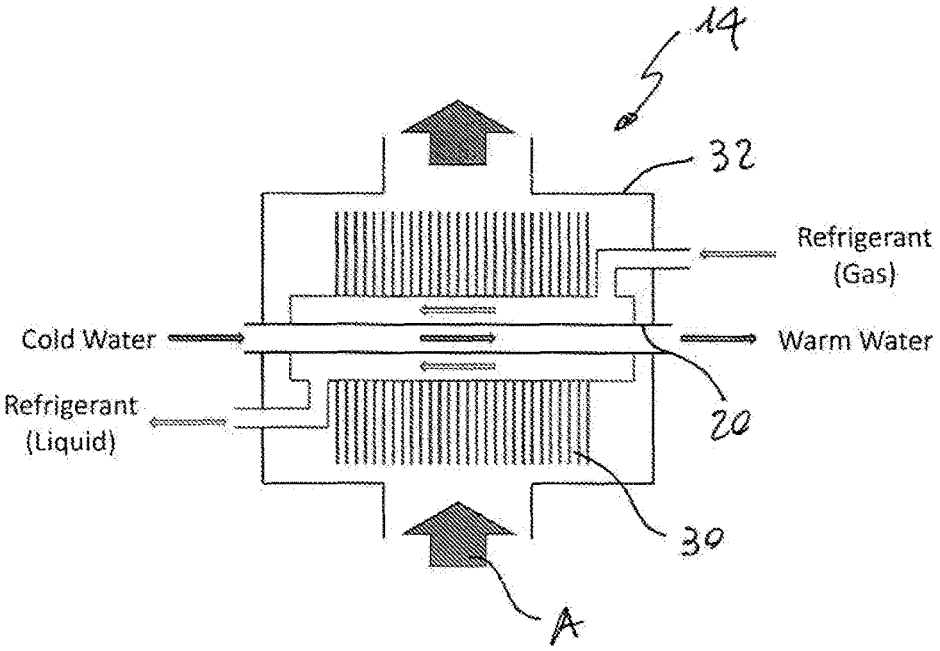
FIG. 4 is a detailed view of the condenser used in the heat pump of FIG. 1.

A possible solution is shown in FIG. 4. The external side of the condenser 14 is completed by adding a number of fins 30 capable of transferring heat from the refrigerant fluid to air. Since the heat transfer coefficient of flowing water is much bigger that the one of the air, the surface of the inner pipe 20 is enough to heat up the water. It is however necessary to greatly increase the exchange surface for the air flow. The heat exchanger is than assembled in an appropriate box-shaped container 32 so that an air stream A, moved by a blower 28, is driven through the fins 30. During the dehumidification phase, the recirculation pump 13 of the washer is off, leaving all of the heat available for the air.

The advantage of a combined condenser 14 as the one described is that in a single component there are integrated the two functions of water heating and air heating.

This allows a cost reduction, as well as a huge simplification of the refrigerant circuit. In fact if a conventional coaxial heat exchanger is used for the water and a conventional tube and fin heat exchanger is used for the air, the heat pump system becomes much more complicated, increasing also the cost thereof.

Of course the washing machine according to the invention may be provided with means for selecting the preferred air ambient humidity, as in usual air dehumidifiers. Moreover, the washing machine according to the invention is equipped with a humidity sensor which switches off the heat pump HP when the target humidity value is reached (such target being within a "comfort area" corresponding to a reasonable humidity in the room).

The washing machine is also equipped with a water sensor level in the tank 22 which switches off the heat pump HP and alerts the user (for instance by a red light on the user interface) that tank 22 has to be emptied.

Even if a washing machine has been described with reference to a washing program and a dehumidifying program as distinct programs which can be selected by the user, the solution according to the invention includes also a washing machine in which the two configurations can be present in the washing program when there is no need to heat he water to be fed in the drum. In this situation, the washing machine according to the invention can automatically activate the deflector 24 and the heat pump system HP when water does not need to be heated and the user has chosen the option of a reduced ambient humidity.

Another advantage of the present invention is that when wet laundry is in the room to dry, the de-humidification of the air increases the drying speed of the load itself. This means that the combination of the washing machine according to the invention and the environment act as an actual "clothes dryer" with the load to be dried outside the appliance.

The operation of such "dryer" is controlled by the same humidity sensor used for reaching target humidity in the room. This means substantially that no more water is evaporating from the wet load and so the load is dry, performing therefore an automatic termination of the "external dryer".

The invention claimed is:

1. A washing machine comprising:

a drum;

a heat pump system comprising an evaporator and a condenser;

a liquid conduit fluidly coupled to the drum and in heat exchange relationship with the condenser such that liquid passing through the conduit is heated by the condenser;

an air channel fluidly coupling the evaporator and condenser to room air while fluidly bypassing the drum to define a room air flow path that bypasses the drum; and a deflector positioned in the air channel between the evaporator and the condenser and moveable between a first position where the deflector diverts said room air flow downstream of the evaporator away from the condenser during a water heating phase of a washing program cycle and a second position where the deflector allows room air to flow from the room, over the evaporator and the condenser, and back into a room air during a dehumidifying program cycle, while bypassing the drum.

2. The washing machine according to claim 1, wherein the deflector is designed to assume a configuration in which the deflector deflects the room air flow towards the air channel downstream of the evaporator.

3. The washing machine according to claim 1, wherein the condenser presents an inner tube in which water is flowing and an outer tube in which refrigerant fluid of the heat pump system is flowing, such outer tube being provided with a plurality of fins.

4. The washing machine according to claim 3, wherein the condenser is placed in a container which is part of the air channel.

5. The washing machine according to claim 1, further comprising a removable tank for collecting condensed water from the evaporator.

6. The washing machine according to claim 5, wherein the tank is provided with a sensor level in order to alert the user when the water level has reached a maximum level.

7. The washing machine according to claim 1, further comprising a user interface configured to choose a washing program or an air dehumidification program or a combination thereof.

8. The washing machine according to claim 1, further comprising an air humidity sensor configured to switch off the heat pump system when a predetermined humidity value is reached.

9. The washing machine according to claim 8, wherein the user can select the predetermined humidity value on the user interface.

10. The washing machine according to claim 1, wherein the air deflector is configured to convey air flow towards the condenser also in a washing program of the machine when water does not need to be heated.

11. The washing machine according to claim 2 wherein the deflector is substantially flush with the air channel when the deflector is deflecting the room air flow toward the air channel downstream of the evaporator.

12. A method of controlling a heat pump in a washing machine comprising a drum and a heat pump system comprising an evaporator and a compressor, the method comprising the step of:

deflecting room air flow downstream of the evaporator away from the condenser and supplying liquid to the drum through a conduit in exchange relationship with the condenser during a water heating phase of a washing program; and allowing room air to flow from a room, over the evaporator and the condenser, and back into a room air during a dehumidifying program cycle, while bypassing the drum.

13. The method according to claim 12, further comprising the step of inputting a threshold value of humidity on a user interface of the machine and switching off the heat pump system when such humidity value is reached.

* * * * *